United States Patent [19]

Inaba et al.

[11] Patent Number: 4,803,492

[45] Date of Patent: Feb. 7, 1989

[54] VEHICLE WINDOW GLASS ANTENNA

[75] Inventors: Hiroshi Inaba; Masao Shinnai; Kazuya Nishikawa; Tamotsu Saitoh; Tokio Tsukada, all of Matsusaka, Japan

[73] Assignee: Central Glass Company, Limited, Ube, Japan

[21] Appl. No.: 933,207

[22] Filed: Nov. 21, 1986

[30] Foreign Application Priority Data

Nov. 25, 1985 [JP] Japan ..... 60-262690
Dec. 13, 1985 [JP] Japan ..... 60-279131

[51] Int. Cl.[4] ..... H01Q 1/32

[52] U.S. Cl. ..... 343/713; 343/704; 219/203

[58] Field of Search ..... 343/711, 712, 713, 704

[56] References Cited

U.S. PATENT DOCUMENTS 4,260,989 4/1981 Ishii et al. ..... 343/713
4,439,771 3/1984 Kume et al. ..... 343/713
4,608,570 8/1986 Inaba et al. ..... 343/704

*Primary Examiner*—William L. Sikes

*Assistant Examiner*—Hoanganh Le

*Attorney, Agent, or Firm*—Foley & Lardner, Schwartz, Jeffery, Schwaab, Mack, Blumenthal & Evans

[57] ABSTRACT

The invention provides an antenna disclosed on or in a vehicle window glass, e.g. an automobile rear window glass, for receiving FM broadcast waves. The antenna has a main element, which extends horizontally from a side marginal region of the glass pane to a middle region but does not intersect the longitudinal center axis of the glass pane, and a phase adjusting element which extends parallel to the main element from the same side marginal region and is connected at its end in the side marginal region to the main element by a perpendicular line. The feed point is connected to an arbitrary point on the perpendicular line. The main element may be folded so as to have at least one horizontally extending turn-back part. The phase adjusting element may extend to the opposite side marginal area of the glass pane and may be folded so as to have a turn-back part which extends horizontally without intersecting the center axis of the glass pane. This antenna is almost non- directional and is high in gain over the entire range of the 76–90 MHz band and the 88–108 MHz band.

12 Claims, 9 Drawing Sheets

VEHICLE WINDOW GLASS ANTENNA

BACKGROUND OF THE INVENTION

This invention relates to a vehicle window glass antenna, i.e. an antenna disposed on or in a vehicle window glass usually for receiving broadcast waves.

In recent automobiles there is a trend to adoption of a so-called window glass antenna, which means disposing conductive strips of an antenna pattern on a window glass, usually rear window glass, in addition to the conventional defogging heater strips.

Known automobile window glass antennas are classified into two types according to relation between the heater strips and the antenna strips. The first type of window glass antennas are characterized by electrical connection between the antenna strips and the heater strips t utilize the heater strips as auxiliary elements of the antenna. However, the antennas of this type have disadvantages and entail inconvenience in several aspects. There is the need of preventing the received wave from passing to the ground via the earth line for the heater strips and also preventing the DC current supplied to the heater strips from flowing to the feeding terminal of the radio receiver. Naturally the electric circuits relating to the window glass antenna become very complicated, and still there is some possibility of a short-circuiting accident attributed to the DC current applied to the heater strips when, for example, relatively thin coaxial cables are used. Besides, the radio receiver is liable to make a disturbing noise while the heater strips are energized.

In the second type of window glass antennas the conductive strips as the antenna elements are independent of the heater strips so that the disadvantages of the first type antennas are obviated. However, in this case it is a serious problem that average gain of the antenna in receiving either an AM broadcast wave or an FM broadcast wave is too low. Furthermore, in the case of receiving an FM broadcast wave the window glass antenna exhibits a highly directional pattern so that it becomes difficult to receive the FM wave from a desired station depending on the head direction of the vehicle. Also it is difficult to form an window glass antenna pattern which is fully effective for reception of FM broadcast waves in both the 76–90 MHz band used in Japan and the 88–108 MHz band used in many other countries. These problems of the second type window glass antennas are fundamentally attributed to the narrowness of the glass area left for the antenna pattern above an array of defogging heater strips.

SUMMARY OF THE INVENTION

It is an object of the present invention to provide a vehicle window glass antenna mainly for receiving FM broadcast waves, which is independent of defogging heater strips disposed on the same window glass and is sufficiently improved in both average gain and directional characteristics over the entire range of the aforementioned two frequency bands, and which is adoptable even when the window glass is relatively narrow in width as in the case of the rear window glass of a hatchback or station-wagon type automobile.

According to the invention, there is provided a vehicle window glass antenna comprising a main element formed of a conductive strip which extends substantially horizontally from a side marginal region of the window glass to a widthways middle region of the window glass and which does not intersect the longitudinal center axis of the window glass, a phase adjusting element formed of a conductive strip which extends substantially parallel to the main element from said side marginal region of the window glass along a length not shorter than $(\lambda/4)\alpha-(\lambda/20)\alpha$, wherein $\lambda$ is the wavelength of an FM wave to be received and $\alpha$ is the wavelength shortening coefficient of the window glass antenna (usually $\alpha$ is about 0.7), and an interconnection line which extends within said marginal region of the window glass substantially perpendicularly to the main and phase adjusting elements and connects an end of the phase adjusting element to an end of the main element. The antenna is electrically connected at an arbitrary point on the interconnection line to a feed point.

The antenna according to the invention serves as an FM broadcast wave receiving antenna and exhibits almost nondirectional characteristic with high average gain for every frequency in both the 76–90 MHz band and the 88–108 MHz band. Such improved characteristic and efficiency are mostly attributed to the function of the main element which is located on one side of the longitudinal center axis of the window glass. The phase adjusting element primarily serves the function of diminishingly adjusting the phase difference between the incoming direct wave and indirect waves reflected from the vehicle body, human bodies, ground, nearby building, etc., and consequently makes a contribution to nondirectional characteristic of the antenna. As the electromotive force induced in the phase adjusting element is combined with the electromotive force induced in the main element the gain of the whole antenna further increases.

Preferred embodiments of the invention include various configurations of the main and phase adjusting elements as will be described hereinafter, and they are classified generally into two types.

The first type configurations are characterized in that the main element of the antenna is folded in the aforementioned middle region of the window glass so as to have a turn-back part which extends substantially horizontally toward the aforementioned side marginal region of the window glass. The turn-back part has an arbitrary length and may be folded so as to provide another turn-back part which extends toward the center axis of the window glass but does not reach the center axis. The phase adjusting element may extend to the opposite side marginal region of the window glass and may be folded so as to have at least one turn-back part not intersecting the center axis of the window glass.

The second type configurations are characterized in that the main element is entirely straight and terminates in the aforementioned middle region of the window glass, and that the phase adjusting element extends to the opposite side marginal region of the window glass and is folded in that region so as to have a turn-back part which extends substantially horizontally along an imaginary extension of the main element to the middle region of the window glass and terminates without intersecting the center axis of the window glass. An antenna of this type may have an auxiliary element which extends substantially horizontally from one of the side marginal regions of the window glass along a length defined by $(\lambda/2^n)\alpha\pm(\lambda/20)\alpha$, wherein n is 1, 2 or 3, and which is arranged such that the main element or the turn-back part of the phase adjusting element extends between the auxiliary element and the longer part of the phase adjusting element. An end of the auxiliary element is connected to either an end of the main element or an end of the phase adjusting element by an interconnection line which extends substantially perpendicular to the auxiliary element within said one of the side marginal regions.

As will be understood from the above statements, every antenna pattern according to the invention is asymmetric with respect to the longitudinal center axis of the window glass. This is an important feature of the invention.

A vehicle window glass antenna according to the invention is usually embodied in an automobile rear window glass. The provision of defogging heater strips on the window glass is not essential to the present invention. When the heater strips are provided, the antenna is preferably located above the heater strips. In that case it is also an advantage of the first type antenna configurations according to the invention that an upper middle region of the window glass remains as a free space, which can be used for installation of, for example, a high-mount stop light according to the recent regulations in the United States. If desired, an antenna according to the invention may be disposed on the front windshield. In any case it is preferable to dispose the antenna in an upper area of the window glass, though it is also possible to dispose it in a middle or lower area of the window glass.

Usually an antenna according to the invention is formed by printing a conductive paste onto the window glass pane and baking the printed paste. When the window glass is laminated glass it is also possible to embed an antenna pattern formed of thin metal wire in a pane of the laminated glass.

DESCRIPTION OF THE PREFERRED EMBODIMENTS

Figure 1:
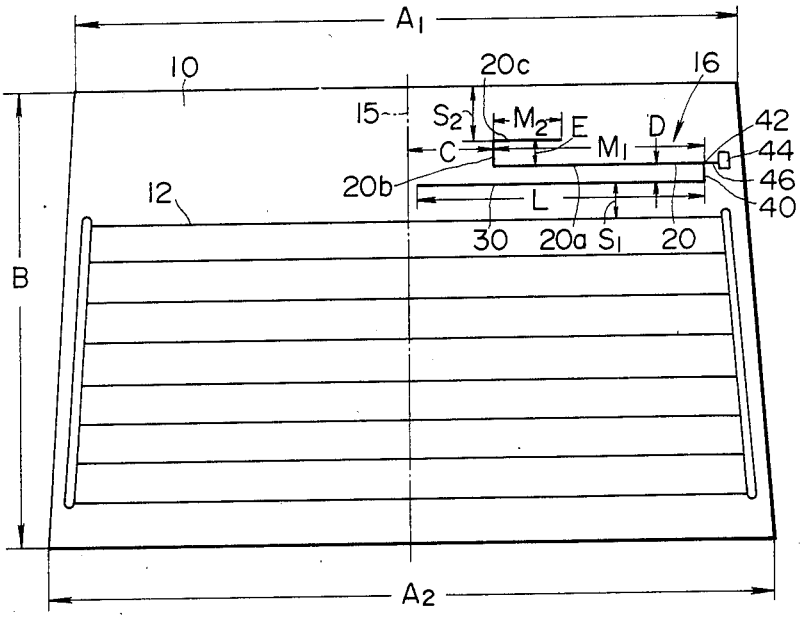
FIG. 1 is a plan view of an automobile rear window glass having an antenna as a first embodiment of the invention.

FIG. 1 shows an automobile rear window glass embodying the present invention. An array of defogging heater strips 12 is disposed on one side of the glass pane 10 so as to leave a relatively narrow free area along the upper edge. In this embodiment an antenna 16 for receiving FM broadcast waves is disposed on the same side of the glass pane 10 by using the righthand half of the free area above the heater strips 12.

The antenna 16 has a first element 20 and a second element 30 which is connected at its one end to an end of the first element 20 by a short interconnection 40. The first element 20 is a conductive strip arranged in a folded pattern. That is, the first element 20 has a base part 20*a* which extends horizontally from a point 42 in the righthand marginal area of the glass pane 10 to a point at a short distance C from the longitudinal center axis 15 of the glass pane 10, a short turn-up part 20*b* which extends upward from the lefthand end of the base part 20*a* and is substantially perpendicular to the base part 20*a* and a turn-back part 20*c* which extends horizontally to the right from the upper end of the turn-up part 20*b*. In the first element 20 the short turn-up part 20*b* is included merely for appropriately spacing the two horizontal parts 20*a* and 20*c*. That is, the base part 20*a* and the turn-back part 20*c* are predominantly important for the function of the first element 20. The second element 30 is a conductive strip which extends below and parallel to the base part 20*a* of the first element 20 at a relatively short vertical distance D therefrom. In this case the second element 30 is longer than the base part 20*a* of the first element 20 but does not intersect the center axis 15 of the glass pane 10. The righthand end of the second element 30 is located just below the end 42 of the first element 20, and the aforementioned interconnection is a short vertical line 40. However, it is also possible to extend the second element 30 across the center axis 15.

The antenna 16 is connected to a feed point 44 located in the righthand marginal area of the glass pane 10 by a short conductor line or strip 46 which extends from the aforementioned point 42 or any arbitrary point on the vertical line 40.

In a sample of the window glass of FIG. 1 the glass pane 10 was 1080 mm in width $A_1$, 1323 mm in width $A_2$ and 698 mm in length B, and the dimensions of and relating to the antenna 16 were as follows. The first element 20:

$M_1$ (base part 20*a*)=390 mm
$M_2$ (turn-back part 20*c*)=140 mm
E (turn-up part 20*b*)=25 mm
C=100 mm
$S_2$ (distance from the upper edge)=65 mm The second element 30:

L (length)=485 mm
D=25 mm
$S_1$ (distance from the uppermost heater strip)=15 mm Using this sample the directional characteristic of the antenna 16 was measured for incoming waves of various frequencies in th FM band allocated to FM broadcasting, viz. 80 MHz, 83 MHz, 86 MHz, 90 MHz, 100 MHz and 105 MHz. The results were as shown in FIGS. 2(A) to 2(F). In every diagram the arrow indicates the head direction of the car body on which the sample window glass was installed, and the curve in solid line represents the directivity patter of the above described antenna 16 whereas the curve in broken line represents the directivity pattern of the first element 20 alone obtained by omitting the second element 30 from the above described sample.

It is understood from these directivity patterns that the sample antenna 16 of FIG. 1 exhibited fairly high gain for the incoming waves from every direction and could be regarded as practically nondirectional. Also it is seen that at every frequency there is a close resemblance between the directivity pattern in broken line and the pattern in solid line. That is, the inclusion of the second element 30 in the antenna did not make a great contribution to the gain. This experimental result demonstrates that the first element 20 functions as the main element of the antenna 16. However, when the second element 30 was omitted dips in the directivity pattern became deeper. This is presumed to be by reason of a phase difference between the direct wave and indirect waves attributed to reflection from the ground and the car body. In other words, the change in the deepness of the dips indicates that the second element 30 of the antenna 16 serves a phase adjusting function and consequently makes an appreciable contribution to improvement of directional characteristic and also to enhancement of gain.

Figure 3:
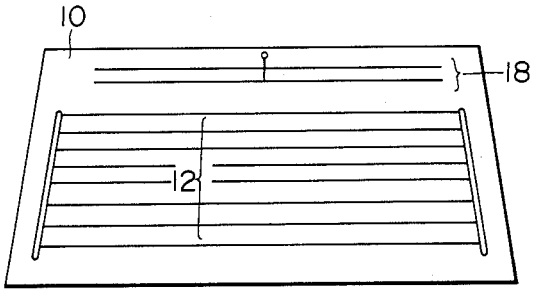
FIG. 3 (PRIOR ART)
FIG. 3 is a plan view of an automobile rear window glass having a conventional antenna.
Figure 4:
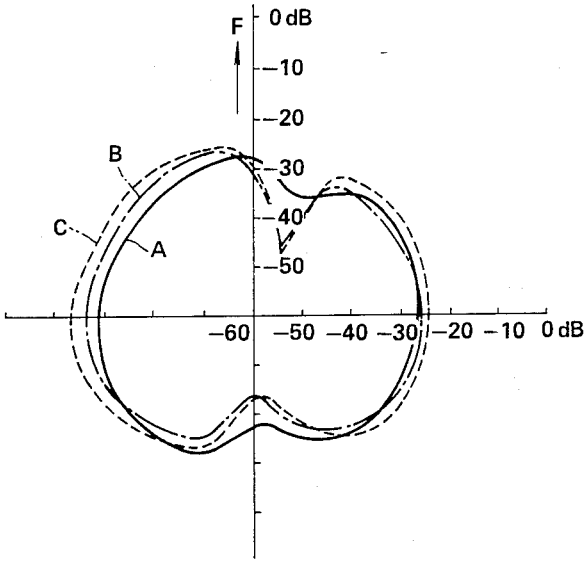
FIG. 4 shows directivity patterns of the antenna in FIG. 3 for FM waves of three different frequencies.
Figure 6A:
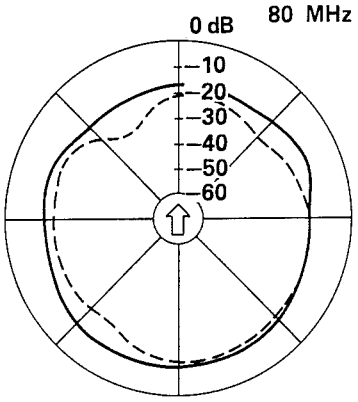
FIGS. 6(A) to 6(F) are diagrams showing directivity patterns of the antenna of FIG. 5 for FM waves of six differnt frequencies, respectively.
Figure 6B:
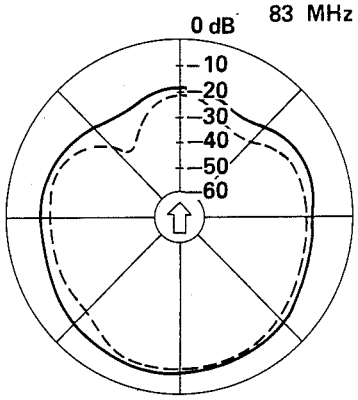
Figure 6C:
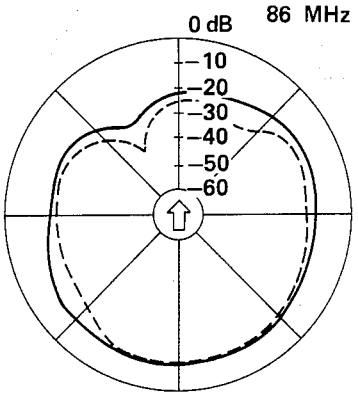
Figure 6D:
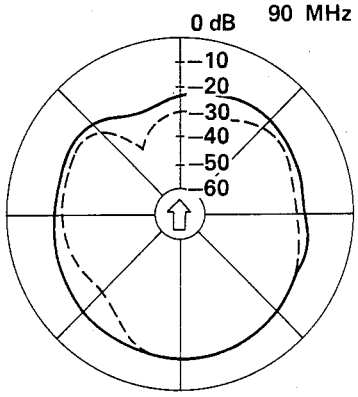
Figure 6E:
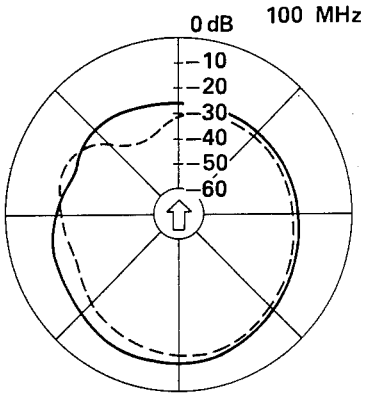
Figure 6F:
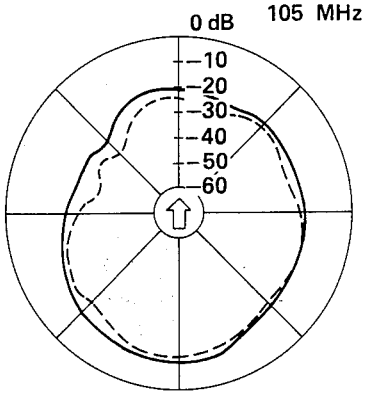

FIG. 3 shows an automobile rear window glass provided with a conventional antenna 18 in an area above the array of heater strips 12. FIG. 4 shows directional characteristics of this antenna 18 measured on the car body used in testing the antenna 16 of FIG. 1. The arrow F indicates the head direction of the car body. The curves A, B and C represent directivity patterns in receiving FM waves of 80 MHz. 83 MHz and 86 MHz, respectively. The basis of gain, 0 dB, refers to the gain of a conventional whip antenna.

Figure 2A:
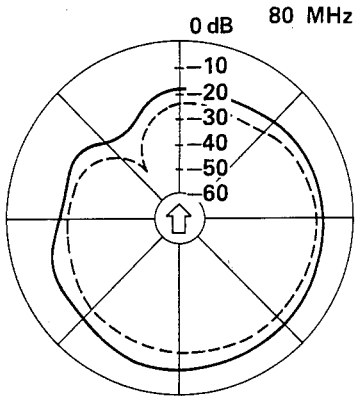
FIGS. 2(A) to 2(F) are diagrams showing directivity patterns of the antenna of FIG. 1 for FM waves of six different frequencies, respectively.
Figure 2B:
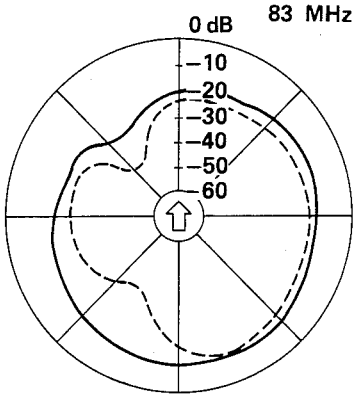
Figure 2C:
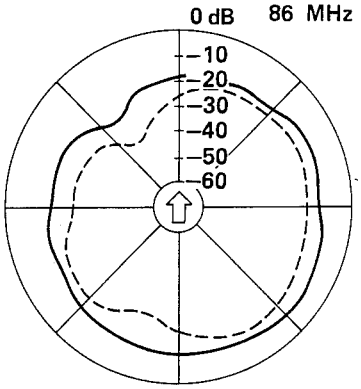
Figure 2D:
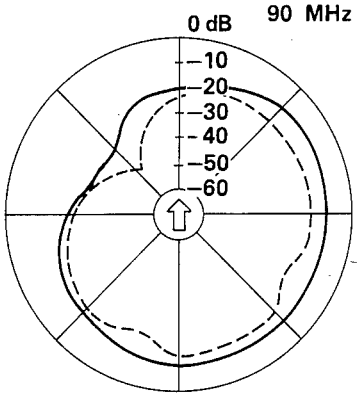
Figure 2E:
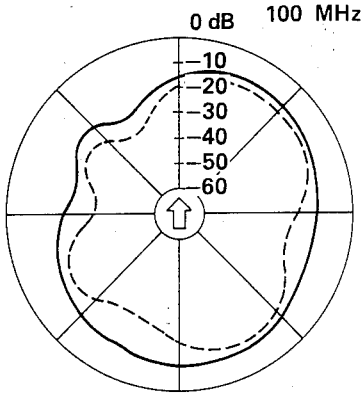
Figure 2F:
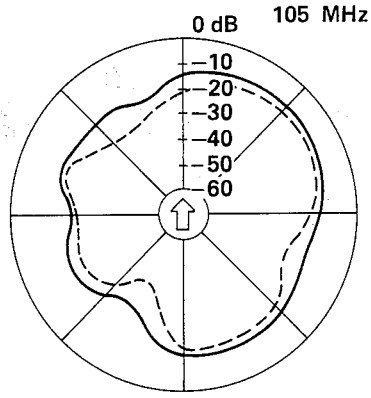

Advantages of the antenna 16 of FIG. 1 are apparent from a comparison between the directional patterns of FIG. 4 and the patterns of FIGS. 2(A) to 2(C). By supplementing the measurement it was revealed that the amount of difference in gain of the antenna 16 of FIG. 1 from the conventional antenna 18 of FIG. 3 in receiving an FM wave was as follows, assuming that the gain of the latter antenna 18 is 0 dB. The gain difference was +8.4 dB at 80 MHz, +6.7 dB at 83 MHz, +9.3 dB at 86 MHz, +8.9 dB at 89 MHz and +8.3 dB on an average in the Japanese domestic FM broadcasting band (76–90 MHz), and +7.9 dB at 90 MHz, +8.8 dB at 95 MHz. +9.9 dB at 100 MHz, +8.2 dB at 105 MHz and +8.7 dB on an average in the FM broadcasting band 88–108 MHz used in, for example, American and European countries. That is, the antenna 16 of FIG. 1 exhibits a remarkable increase in gain for incoming waves in either of the two FM broadcasting bands.

Figure 5:
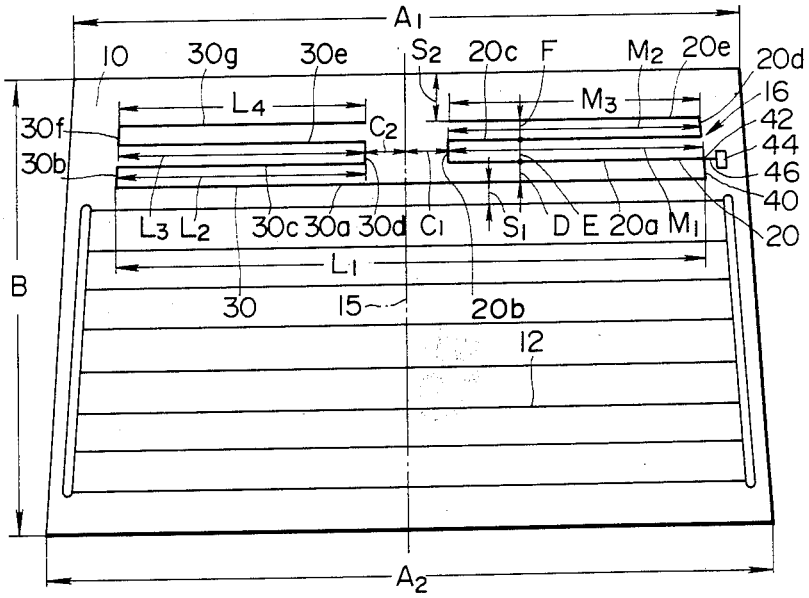
FIG. 5 is a plan view of an automobile rear window glass having an antenna as a second embodiment of the invention.

FIG. 5 shows a second embodiment of the invention in respect of the configuration of the receiving antenna 16. In this case the first element 20 of the antenna 16 is a conductive strip folded in twice so as to have two turn-back parts 20*c* and 20*e* both of which ar parallel to the horizontal base part 20*a*, and the second element 30 is a conductive strip which has a relatively long horizontal base part 30*a* and is folded in thrice so as to have three parallel turn-back parts 30*c*, 30*e* and 30*g*. The first element 20 is similar to the counterpart in FIG. 1 in the arrangement of the base part 20*a* and in the manner of the first folding at a short distance $C_1$ from the center axis 15. The first turn-back part 20*c* has nearly the same length as the base part 20*a*, and the second folding in the righthand marginal area of the glass pane 10 gives a second turn-up part 20*d* having a short length F and a second turn-back part 20*e* which extends to the left and has nearly the same length as the first turn-back part 20*c*. In the second element 30 the base part 30*a* extends from the righthand marginal area to the lefthand marginal area of the glass pane 10 below the first element 20 at a vertical distance D therefrom, and the first folding gives a turn-up part 30*b* whose length is equal to the aforementioned distance D and the first turn-back part 30*c* which extends toward the center axis 15 to leave a short distance $C_2$ from the axis 15. The second folding gives a second turn-up part 30*d* having nearly the same length E as the turn-up part 20*b* of the first element 20 and the second turn-back part 30*e* which extends to the left and has nearly the same length as the first turn-back part 30*c*. The third folding gives another turn-up part 30*f* having the same length F as the turn-up part 20*d* of the first element 20 and the third turn-back part 30*g* which extends toward the center axis 15 and terminates before intersecting the axis 15.

The righthand end of the base part 30*a* of the second element 30 is connected by the perpendicular interconnection 40 to the righthand end 42 of the base part 20*a* of the first element 20, and the short conductor line 46 extends from the intersection point 42 to the feed point 44.

In a sample of the window glass of FIG. 5 the glass pane 10 was 1120 mm in width $A_1$, 1480 mm in width $A_2$ and 504 mm in width B, and the dimensions of and relating to the antenna 16 were as follows. The first element 20:

$M_1$ (base part 20*a*)=430 mm
$M_2$ (turn-back part 20*c*)=420 mm
$M_3$ (turn-back part 20*e*)=415 mm
E (turn-up part 20*b*)=25 mm
F (turn-up part 20*d*)=25 mm
$C_1$=20 mm
$S_2$=55 mm The second element 30:

$L_1$ (base part 30*a*)=915 mm
$L_2$ (turn-back part 30*c*)=430 mm
$L_3$ (turn-back part 30*e*)=420 mm
$L_4$ (turn-back part 30*g*)=415 mm
$C_2$=20 mm
$S_1$=20 mm Using this sample the directional characteristic of the antenna 16 of FIG. 5 was measured for FM waves of 80 MHz, 83 MHz, 86 MHz. 90 MHz, 100 MHz and 105 MHz. The results were as shown in FIGS. 6(A) to 6(F) wherein the arrow and the curve in broken line are in the same sense as in FIGS. 2(A)–2(F). These directivity patterns can be taken as very favorable for a receiving antenna on a vehicle. Also it is understood that the first element 20 functions as the main element of the antenna 16 of FIG. 5, while the second element 30 has the function of adjusting the phase difference between the direct wave and reflected waves and consequently contributes to the enhanced gain and improved directional characteristic. By comparison with the conventional antenna 18 of FIG. 3, the amount of difference in gain of the antenna 16 of FIG. 5 was as follows, assuming that the gain of the former antenna 18 is 0 dB. The gain difference was +8.9 dB at 80 MHz, +6.2 dB at 83 MHz. +6.6 dB at 86 MHz. +4.7 dB 89 MHz and +7.4 dB on an average in the 76–90 MHz band, and +6.7 dB at 90 MHz, +6.2 dB at 95 MHz, +5.5 dB at 100 MHz. +4.9 dB at 105 MHz and +5.8 dB on an average in the 88–108 MHz band. Thus, the sample antenna of FIG. 5 was nearly equivalent in the antenna efficiency to the sample antenna of FIG. 1.

Figure 7:
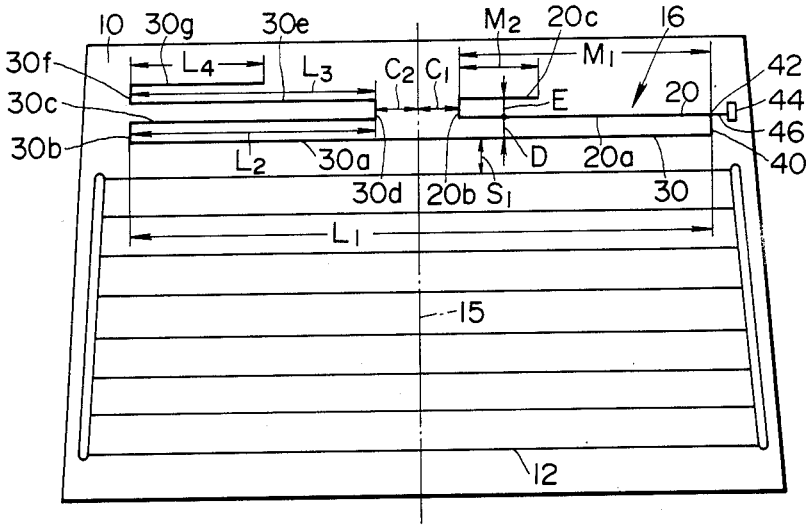
FIGS. 7 to 9 are plan views of automobile rear window glasses having antennas as third, fourth and fifth embodiments of the invention, respectively.

FIG. 7 shows a third embodiment of the invention. In this antenna 16 the first element 20 is almost similar to the counterpart in FIG. 1, and the second element 30 is fundamentally similar to the counterpart in FIG. 5. In a sample of the window glass of FIG. 7 the dimensions of the glass pane 10 were as mentioned with respect to FIG. 5, and the lengths of the horizontal parts of the antenna elements were as follows. In the first element 20: $M_1=430$ mm, and $M_2=250$ mm. In the second element 30: $L_1=915$ mm, $L_2=430$ mm, $L_3=425$ mm, and $L_4=300$ mm. The values of $C_1$, $C_2$, D, E, F and $S_1$ were as mentioned with respect to FIG. 5. The results of testing this sample antenna were nearly equivalent to the results of testing the antenna of FIGS. 1 and 5 in both directional characteristic and gain as an FM receiving antenna.

Figure 8:
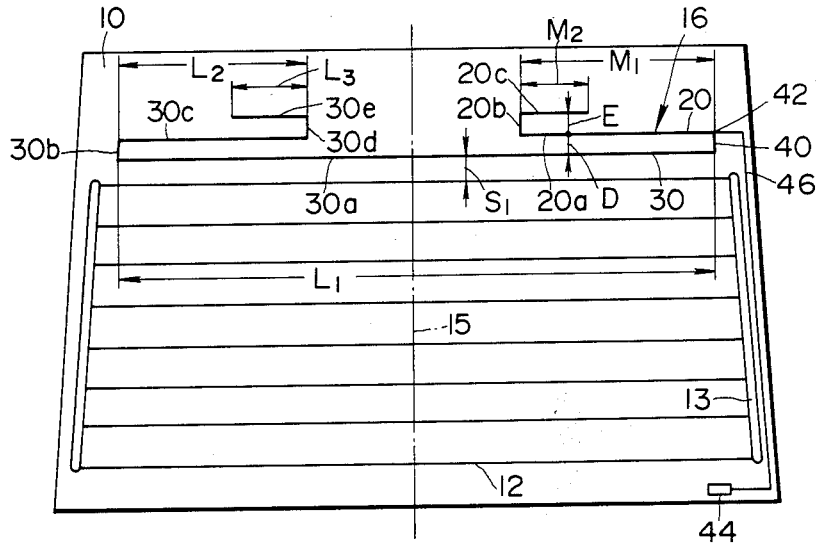

FIG. 8 shows a fourth embodiment of the invention. In this antenna 16 the first element 20 is an almost exact counterpart of the element 20 in FIG. 1, and the second element 30 can be taken as simplification of the counterpart in FIG. 7 by omission of the third turn-back part **30*g* together with the third turn-up part 30*f*. In a sample of the window glass of FIG. 8 the dimensions of the glass pane 10 were as mentioned with respect to FIG. 1, and the lengths of the horizontal parts of the antenna elements were as follows. In the first element 20: $M_1=380$ mm, and $M_2 140$ mm. In the second element 30: $L_1=985$ mm, $L_2=395$ mm, and $L_3=140$ mm. The values of D, E and $S_1$ were as mentioned with respect to FIG. 1. In this case the feed point 44 is located in the lower marginal area of the glass pane 10 on the assumption that disposition of the feeder wire (not shown) would encounter difficulty if the feed point 44 were located in an upper area of the glass pane 10 for some reason of the car body construction. Accordingly the interconnection line 46 long extends along the right-hand edge of the glass pane 10. In such a case it is suitable to arrange the interconnection line 46 at a close distance such as about 2 mm from the bus bar 13 of the heater wires 12 to thereby establish capacitive coupling. The results of testing this sample antenna were nearly equivalent to the results of testing the antennas of FIGS. 1, 5 and 7** in both directional characteristic and gain as an FM receiving antenna.

In the above described embodiments of the invention the first or main element 20 of the antenna is always folded so as to have at least one turn-back part, and it is optional to form the second element 30 too in a folded pattern. For each antenna element the optimums of the number of folding or turning and the total length of the horizontal parts are variable depending on the particulars of the car body design including, for example, the shape and dimensions of the opening for use as the window, the inclination of the window glass pane and the length and location of the feeder cable. In general the standard of the pattern and length of each antenna element is as follows with respect to the antennas of FIGS. 1, 5, 7 and 8.

As to the main element 20, existence of only one turn-back part (**20*c*) is rather advantageous when the window glass has a relatively large width as in the case of a sedan or hardtop type car, and in that case an optimum value of the effective total length M ($=M_1+M_2$) is in the range from $(\lambda/5)\alpha$ to $(\lambda/4)\alpha$, viz. from 420 to 620 mm. When the window glass is relatively narrow in width as in the case of a hatchback type car there is neither merit nor demerit in varying the number of turning of the main element 20** so that a suitable selection can be made according to the particulars of the car body design. If the number of turning is only one, an optimum value of the effective total length M ($=M_1+M_2$) is in the range $(\lambda/3)\alpha\pm(\lambda/20)\alpha$, viz from 595 to 950 mm. If the number of turning is two, an optimum value of M ($M_1+M_2+M_3$) is in the range $(\lambda/2)\alpha\pm(\lambda/20)\alpha$, viz. from 945 to 1360 mm.

As to the second element 30 for the phase adjusting purpose, there is neither merit nor demerit in forming at least one turn-back part when the window glass has a relatively large width as in a sedan type car. If no turn-back part is formed an optimum value of the length L is in the range $(\lambda/4)\alpha\pm(\lambda/20)\alpha$, viz. from 420 to 745 mm. If only one turn-back part (**30*c*) is formed an optimum value of L ($=L_1+L_2$) is in the range $(\lambda/2)\alpha\pm(\lambda/20)\alpha$, viz. from 945 to 1360 mm. If two turn-back parts are formed an optimum value of L ($=L_1+L_2+L_3$) is either in the range $(3\lambda/4)\alpha\pm(\lambda/20)\alpha$, viz. from 1470 to 1975 mm, or in the range $\lambda\alpha\pm(\lambda/20)\alpha$, viz. from 1990 to 2595 mm. If three turn-back parts are formed an optimum value of L ($=L_1+L_2+L_3+L_4$) is in the range $\lambda\alpha\pm(\lambda/20)\alpha$, viz. from 1990 to 2595 mm. When the window glass is relatively narrow in width as in the case of a hatchback type car it is preferable that the second element 30 has at least one turn-back part. If only one turn-back part is formed an optimum value of L ($L=L_1+L_2$) is in the range $(\lambda/2)\alpha\pm(\lambda/20)\alpha$, viz. from 945 to 1360 mm. If two turn-back parts are formed an optimum value of L ($=L_1+L_2+L_3$) is in the range $(3\lambda/4)\alpha\pm(\lambda/20)\alpha$, viz. from 1470 to 1975 mm. If three turn-back parts are formed an optimum value of L ($=L_1+L_2+L_3+L_4$) is in the range $\lambda\alpha\pm(\lambda/20)\alpha$, viz. from 1990 to 2595 mm. In every case the second element 30 must have a base part that extends parallel to the base part of the first element 20** and is not shorter than $(\lambda/4)\alpha-(\lambda/20)\alpha$, viz. not shorter than 420 mm.

Figure 9:
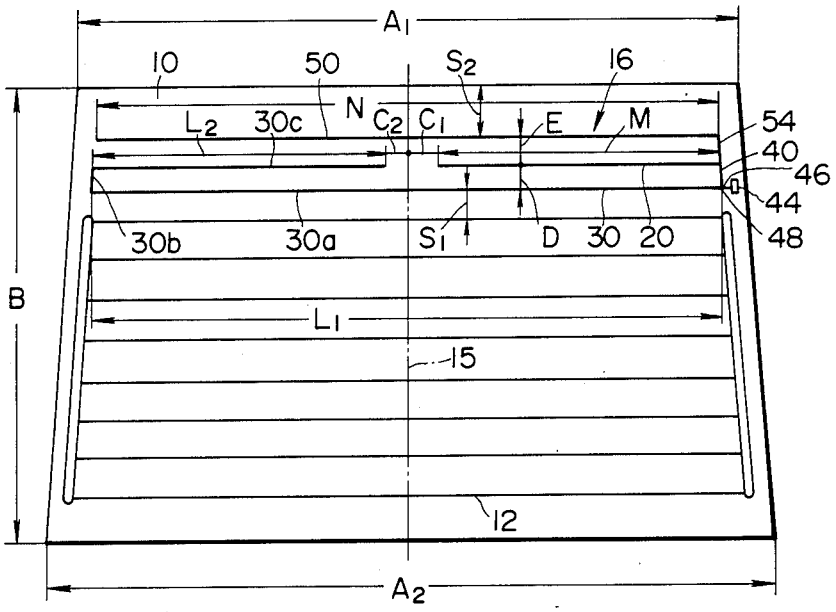

FIG. 9 shows a fifth embodiment of the invention in respect of the configuration of the receiving antenna 16. In this case the antenna 16 has a first element 20 which extends horizontally from the righthand marginal area of the glass pane 10 and terminates at a short distance $C_1$ from the center axis 15, a second element 30 having a base part **30*a* disposed below and parallel to the first element 20 to extend from the righthand marginal area to the lefthand marginal area of the glass pane 10, a short turn-up part 30*b* which extends upward from the lefthand end of the base part 30*a* and a turn-back part 30*c* which extends horizontally to the right from the upper end of the turn-up part 30*c* and terminates at a short distance $C_2$ from the center axis 15, and a third element 50 which extends above and parallel to the first element 20 from the righthand marginal area to the lefthand marginal area of the glass pane 10. The first element 20 and the turn-back part 30*c* of the second element 30 are at the same vertical distance D from the base part 30*a* of the second element 30, and the vertical distance E of the third element 50 from the first element 20 is nearly equal to the distance D. The righthand end of the first element 20 is connected by the short vertical line 40 to the righthand end of the second element 30, and to the righthand end of the third element 50 by a short vertical line 54. The antenna 16 is connected to the feed point 44 by the short conductor line 46 which extends from the lower end 48 or any other point on the interconnection line 40**.

In a sample of the window glass of FIG. 9 the glass pane 10 was 1120 mm in width $A_1$, 1480 mm in width $A_2$ and 504 mm in length B. and the dimensions of and relating to the antenna 16 were as follows. The first element 20:

M (length)=530 mm
$C_1$=20 mm

The second element 30:

$L_1$ (base part 30*a*)=1125 mm
$L_2$ (turn-back part 30*c*)=530 mm
D=30 mm
$S_1$=25 mm
$C_2$=20 mm The third element 50:

N (length)=1085 mm
E=30 mm
$S_2$=65 mm

Using this sample the directional characteristic of the antenna 16 was measured for FM waves of 80 MHz, 83 MHz, 86 MHz and 89 MHz. The results were as shown in FIGS. 10(A) to 10(D). In every diagram the arrow indicates the head direction of the car body on which the sample window glass was installed, and the curve in broken line represents a directivity pattern obtained when the second element 20 was omitted from the above described sample.

It is understood from these directivity patterns that the sample antenna 16 of FIG. 9 exhibited fairly high gain for the incoming waves from every direction and could be regarded as practically nondirectional. Also it is seen that the omission of the second element 30 resulted in only a slight decrease in the gain, and therefore it is apparent that the gain of this antenna is mostly attributed to the first element 20 and/or the third element 50. In a supplemental experiment, the first element 20 and the third element 50 were alternately omitted to examine the manner of changes in the gain in receiving an FM wave. The gain of the antenna 16 including the first, second and third elements 20, 30 and 50 was taken as the basis, 0 dB. In the case of utilizing only the second element 30 and the third element 50, the gain difference was −7.8 dB at 80 MHz, −7.8 dB at 83 MHz. −4.8 dB at 86 MHz. −2.2 dB at 89 MHz and −5.7 dB on an average in the FM broadcasting band 76–90 MHz. In the case of utilizing only the first element 20 and the second element 30, the gain difference was −1.3 dB at 80 MHz, −2.6 dB at 83 MHz, −4.8 dB at 86 MHz, −0.3 dB at 89 MHz and −1.4 dB on an average in the 76–90 MHz band. Therefore, it is certain that the first element 20 predominantly contributes to the high gain of the antenna 16 of FIG. 9 and serves as the main antenna element. Also it is understood that the third element 50 serves as an auxiliary antenna element which is effective in further increasing the gain of the receiving antenna to some extent over the entire range of the FM broadcasting band. In FIGS. 10(A) to 10(F) the directivity patterns in broken line have deepened dips. This fact indicates that, in the antenna of FIG. 9 too, the second element 30 serves the function of adjusting the phase difference between the direct wave and reflected indirect waves.

By comparison with the conventional antenna 18 of FIG. 3, the antenna 16 of FIG. 9 was remarkably higher in gain. Assuming that the gain of the conventional antenna 18 is 0 dB. the gain difference was +2.8 dB at 80 MHz, +4.0 dB at 83 MHz, +6.0 dB at 86 MHz, +5.5 dB at 89 MHz and +4.6 dB on an average in the 76–90 MHz band.

Figure 11:
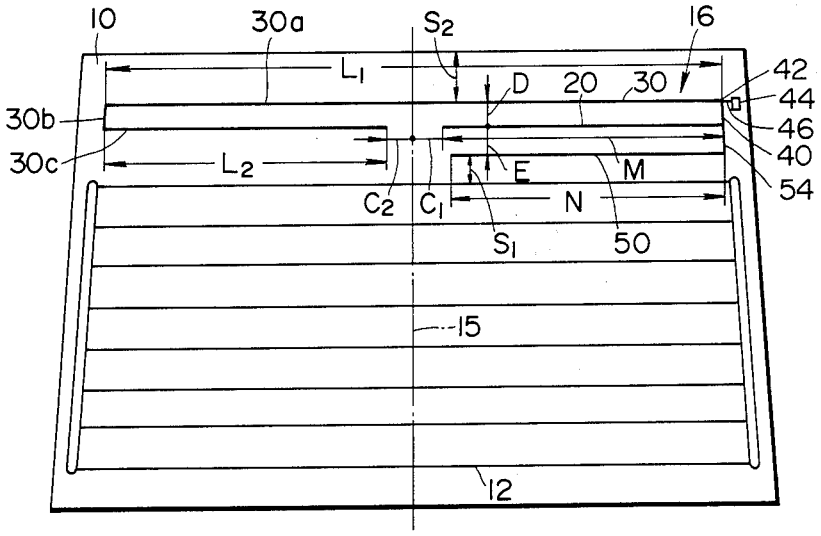
FIGS. 11 to 13 are plan views of automobile rear window glasses having antennas as sixth seventh and eighth embodiments of the invention, respectively.
Figure 10A:
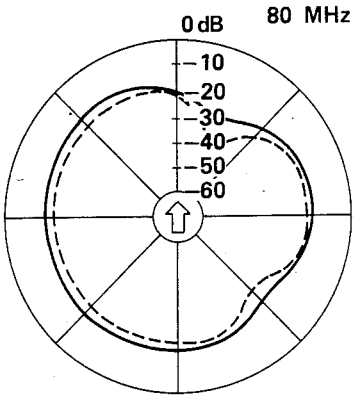
FIGS. 10(A) to 10(D) ar diagrams showing directivity patterns of the antenna of FIG. 9 for FM waves of four different frequencies, respectively.
Figure 10B:
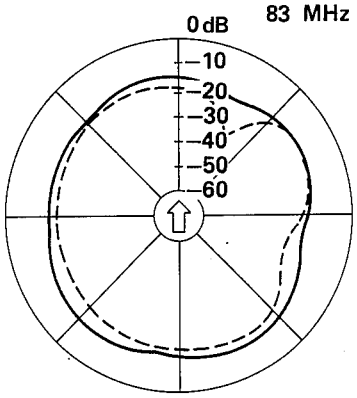
Figure 10C:
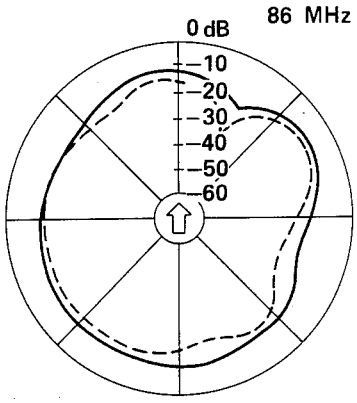
Figure 10D:
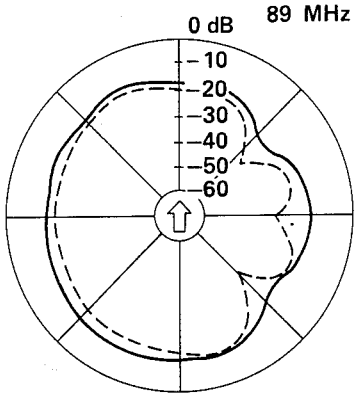

FIG. 11 shows a sixth embodiment of the invention. The antenna 16 in this embodiment consists of first, second and third elements 20, 30 and 50. The first element 20 is an exact counterpart of the element 20 in FIG. 9 and serves as the main element. The arrangement of the second element 30 and the third element 50 with respect to the first element 20 is reverse to the arrangement in the antenna of FIG. 9, and the third element 50 has nearly the same length as first element 20. In a sample of the window glass of FIG. 11 the dimensions of the glass pane 10 were as mentioned with respect to FIG. 9, and the lengths of the horizontal parts of he antenna elements were as follows: M=530 mm, $L_1$=1110 mm, $L_2$=530 mm, and N=520 mm. The values of $C_1$, $C_2$, D, E, $S_1$ and $S_2$ were as mentioned with respect to FIG. 9. As an FM wave receiving antenna and by comparison with the gain of the conventional antenna 18 in FIG. 3, the gain of this sample antenna was +2.3 dB at 80 MHz, +1.8 dB at 83 MHz, +4.9 dB at 86 MHz, +6.7 dB at 89 MHz and +3.9 dB on an average in the 76–90 MHz band.

Figure 12:
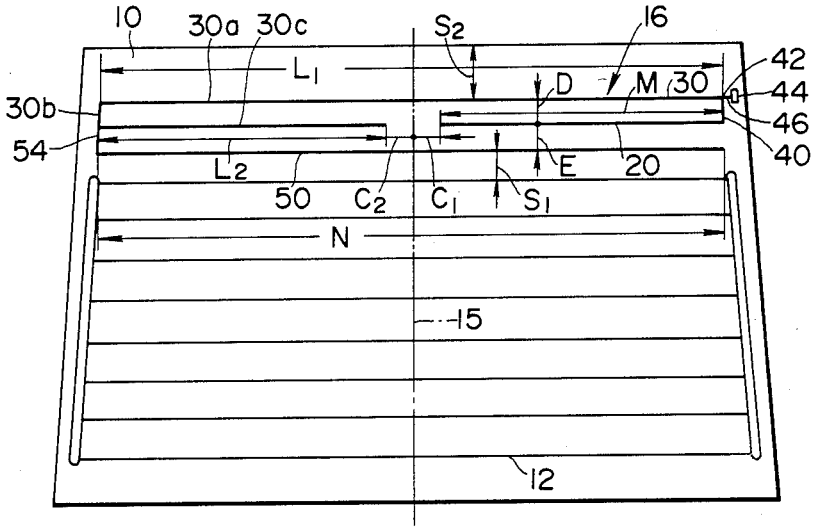

FIG. 12 shows a seventh embodiment of the invention. The antenna 16 in this embodiment is fundamentally similar to the antenna in FIG. 9. As the sole point of modification, the third element 50 is connected at its lefthand end to the second element 30, not to the first element 20, by a perpendicular interconnection line 54. In a sample of the window glass of FIG. 12 the dimensions of the glass pane 10 were as mentioned with respect to FIG. 9, and the lengths of the horizontal parts of the antenna elements were: M=530 mm, $L_1$=1100 mm, $L_2$=530 mm, and N=1130 mm. The values of $C_1$, $C_2$, D, E, $S_1$ and $S_2$ were as mentioned with respect to FIG. 9. By comparison with the conventional antenna 18 in FIG. 3, the gain of this sample antenna 16 was +4.1 dB at 80 MHz, +3.7 dB at 83 MHz, +4.9 dB at 86 MHz. +6.8 dB at 89 MHz and +4.9 dB on an average in the 76–90 MHz band.

Figure 13:
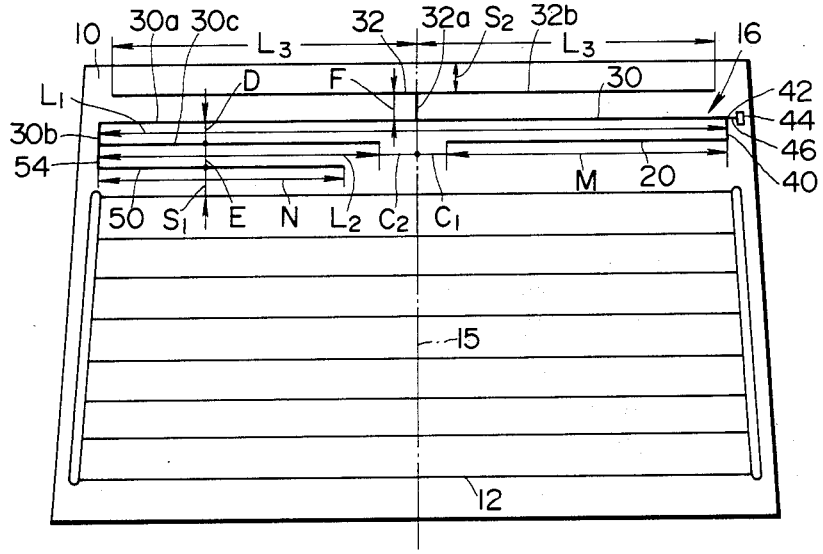
Figure 14A:
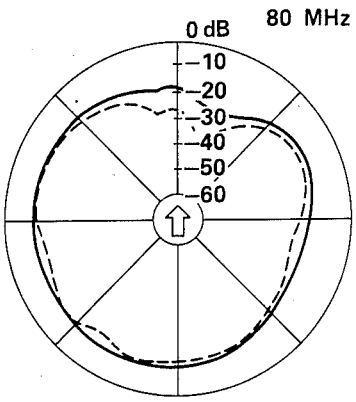
FIGS. 14(A) to 14(D) are diagrams showing directivity patterns of the antenna of FIG. 13 for FM waves of four different frequencies, respectively.
Figure 14B:
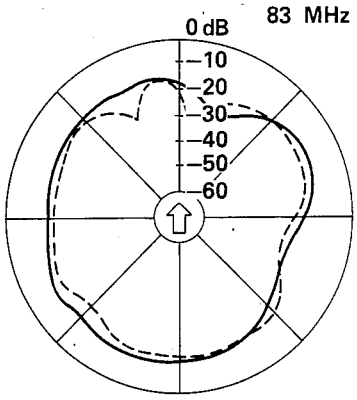
Figure 14C:
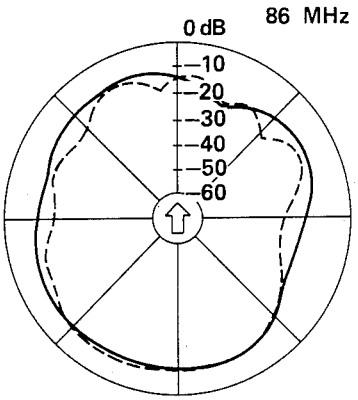
Figure 14D:
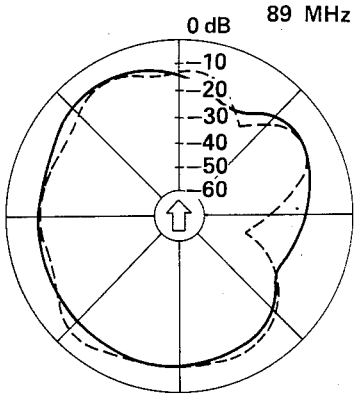

FIG. 13 shows an eighth embodiment of the invention. The antenna 16 in this embodiment differs from the antenna in FIG. 12 in that a T-shaped antenna element 32 is supplemented to the long base part 30*a* of the second element 30 and that the third element 50 is shortened so as not to intersect the center axis 15 of the glass pane 10. However, it is also possible to extend the third element 50 across the center axis 15. The T-shaped element 32 consists of a leg part 32*a*, which extends upward from the middle of the long base part 30*a* of the second element 30 and has a relatively short length F. and a relatively long horizontal part 32*b* which extends parallel to the base part 30*a* of the second element 30 and has a given length $L_3$ on either side of the center axis 15. In a sample of the window glass of FIG. 13 the dimensions of the glass pane 10 were as mentioned with respect to FIG. 9, and the dimensions of and relating to the antenna 16 were as follows. M=530 mm, $L_1$=1100 mm, $L_2$=530 mm, $L_3$=540 mm, N=480 mm, $C_1$=$C_2$=20 mm, D=E=F=25 mm, $S_1$=20 mm and $S_2$=55 mm. Using this sample the directional characteristic of the antenna 16 of FIG. 13 was measured for FM waves of 80 MHz, 83 MHz, 86 MHz and 89 MHz. The results were as shown in FIGS. 14(A) to 14(D) wherein the arrow and the curve in broken line are in the same sense as in FIGS. 10(A)–10(D). These directivity patterns are very favorable for a receiving antenna on a vehicle. Also in this case the first element 20 proved to function as the main antenna element, and the second element 30 including the T-shaped element 32 served the purpose of adjusting the phase difference between the direct wave and reflected indirect waves and consequently contributed to the increased gain and improved directional characteristic. By comparison with the conventional antenna 18 in FIG. 13, the gain of the antenna 16 in this embodiment was +6.9 dB at 80 MHz, +5.4 dB at 83 MHz. +7.6 dB at 86 MHz, +8.1 dB at 89 MHz and +7.6 dB on an average in the 76–90 MHz band. That is, the gain of this antenna was higher than that of the antenna of FIG. 9, FIG. 11 or FIG. 12.

In the embodiments shown in FIGS. 9, 11, 12 and 13, the first or main element 20 of the antenna is always straight and extends from a side marginal area of the glass pane 10 to the middle area and terminates before intersecting the center axis 15. In these elements, the second element 30 has a base part 30*a* which is parallel to the first element 20 and extends from a side marginal area of the glass pane to the opposite side marginal area and a turn-back part 30*c* which extends toward the middle area of the glass pane approximately along an imaginary extension of the first element 20 and terminates before intersecting the center axis 15, and the antenna includes the third element 50 which extends parallel to the first element 20, from a side marginal area of the glass pane. For each antenna of this type the optimums of the antenna pattern and the lengths of the horizontal parts are variable depending on the particulars of the car body design. In general the standard of the length of each antenna element is as follows with respect to the antenna of FIGS. 9, 11, 12 and 13.

As to the main element 20, an optimum of length M is in the range $(\lambda/4)\alpha\pm(\lambda/20)\alpha$, viz. in the range from 420 to 745 mm.

As to the second element 30 for the phase adjusting purpose, an optimum of the total length of the long base part 30*a* and the relatively short turn-up part 30*c*, $L_1+L_2$, is in the range $(\lambda/2)\alpha\pm(\lambda/20)\alpha$, viz. from 945 to 1360 mm, when the window glass is relatively narrow in width as in the case of a hatchback type car. When the window glass has a relatively large width as in the case of a sedan type car, an optimum of $L_1+L_2$ is either in the range $(\lambda/2)\alpha\pm(\lambda/20)\alpha$, viz. from 945 to 1360 mm, or in the range $(3\lambda/4)\alpha\pm(\lambda/20)\alpha$, viz. from 1470 to 1975 mm. The addition of the T-shaped element 32 is optional in any case.

As to the auxiliary third element 50, there are three definite ranges of its length N. The first range is $(\lambda/2)\alpha\pm(\lambda/20)\alpha$, viz. from 945 to 1360 mm. The second range is $(\lambda/4)\alpha\pm(\lambda/20)\alpha$, viz. from 420 to 745 mm. The third range is $(\lambda/8)\alpha\pm(\lambda/20)\alpha$, viz. from 150 to 350 mm.

What is claimed is:

1. A two-element antenna attached to a vehicle window glass having right and left side marginal regions and a middle region containing a center axis of the window glass between said side marginal regions; said antenna comprising:

a main antenna element formed of a conductive strip which extends substantially horizontally from one side marginal region of the window glass to said middle region of the window glass without intersecting said center axis and is folded in said middle region so as to have a turn-back part which extends substantially horizontally toward said one side marginal region;

a phase adjusting antenna element formed of a conductive strip which extends substantially parallel to said main element from said one side marginal region of the window glass along a length not shorter than $(\lambda/4)\alpha-(\lambda/20)\alpha$, wherein $\lambda$ is the wavelength of an FM wave to be received and is the wavelength shortening coefficient of the antenna; and an interconnection line which extends within said side marginal region of the window glass substantially perpendicularly to the main and phase adjusting antenna elements and connects an end of said phase adjusting element to an end of said main element, the antenna being electrically connected at an arbitrary point on said interconnection line to a feed point.

2. An antenna according to claim 1, wherein the total horizontal length of said main antenna element is in the range from $(\lambda/5)\alpha$ to $(\lambda/4)\alpha$.

3. An antenna according to claim 1, wherein the total horizontal length of said main antenna element is $(\lambda/3)\alpha\pm(\lambda/20)\alpha$.

4. An antenna according to claim 1, wherein said phase adjusting antenna element extends to the opposite side marginal region of the window glass and is folded so as to have at least one turn-back part extending substantially horizontally.

5. An antenna according to claim 1, formed by applying a conductive paste onto the window glass and baking the applied paste.

6. An antenna according to claim 1, wherein the window glass is a laminated glass, the antenna being embedded in the laminated glass.

7. An antenna according to claim 1, wherein said main antenna element has a single turn-back part, and the length of the main element is in the range from $(\lambda/5)\alpha$ to $(\lambda/4)\alpha$.

8. An antenna according to claim 1, wherein said main antenna element has two turn-back parts, and the length of said main element is $(\lambda/2)\alpha\pm(\lambda/20)\alpha$.

9. An antenna according to claim 1, wherein said phase adjusting antenna element consists of a single straight strip having a length $(\lambda/4)\alpha\pm(\lambda/20)\alpha$.

10. An antenna according to claim 1, wherein said phase adjusting element has a single turn-back part, and the length of the phase adjusting antenna element is $(\lambda/2)\alpha\pm(\lambda/20)\alpha$.

11. An antenna according to claim 1, wherein said phase adjusting antenna element has two turn-back parts, and the length of the phase adjusting element is $(3\lambda/4)\alpha\pm(\lambda/20)\alpha$.

12. An antenna according to claim 1, wherein said phase adjusting, antenna has three turn-back parts, and the length of the phase adjusting element is $\lambda\alpha\pm(\lambda/20)\alpha$.

* * * * *